313-414 SR

9/8/81 OR 4,288,718

United States Patent [19]

Blacker et al.

[11] 4,288,718

[45] Sep. 8, 1981

[54] MEANS AND METHOD FOR BEAM SPOT DISTORTION COMPENSATION IN TV PICTURE TUBES

[75] Inventors: Allen P. Blacker, Hoffman Estates; Arthur J. Ingle, Bartlett, both of Ill.

[73] Assignee: Zenith Radio Corporation, Glenview, Ill.

[21] Appl. No.: 42,280

[22] Filed: May 24, 1979

[51] Int. Cl.[3] ..... H01J 9/14; H01J 29/62

[52] U.S. Cl. ..... 313/414; 29/25.18; 313/412

[58] Field of Search ..... 313/414, 412; 29/25.18

[56] References Cited

U.S. PATENT DOCUMENTS

| | | | |
|---|---|---|---|
| 3,678,316 | 7/1972 | Barten | 313/414 X |
| 3,995,194 | 11/1976 | Blacker, Jr. et al. . | |
| 4,050,041 | 9/1977 | Schiecke . | |
| 4,058,753 | 11/1977 | Blacker et al. . | |
| 4,086,513 | 4/1978 | Evans, Jr. . | |
| 4,143,293 | 6/1979 | Hosokoshi et al. | 313/414 X |

OTHER PUBLICATIONS

"Trinitron Color Picture Tube . . .", by S. Yoshida et al., *IEEE Transactions on Broadcast and Television Receivers,* Aug. 1974, vol. BTR-20, No. 3, pp. 193-199.

*Primary Examiner*—Palmer C. Demeo
*Attorney, Agent, or Firm*—Ralph E. Clarke, Jr.

[57] ABSTRACT

A television cathode ray picture tube has at least one electron gun for generating at least one electron beam for projecting at least one beam spot on the picture imaging screen of the tube. The gun has a plurality of differently electrically charged electrodes having facing sections comprising juxtaposed walls with coaxially aligned openings therethrough for passage of said beam, said walls defining at least one gap in which is established a beam-focusing electrostatic field. The tube is subject to influences which introduce an undesired distortion of the beam spot to the detriment of the quality of the image projected on the screen. The electron gun is characterized by at least one of the electrode walls being mechanically deformed in the perimeter of its opening to cause the field to be azimuthally asymmetrical about the opening. The mechanical deformation is effective to act on the beam in a sense tending to at least partially compensate for the undesired distortion of the beam spot.

17 Claims, 16 Drawing Figures

MEANS AND METHOD FOR BEAM SPOT DISTORTION COMPENSATION IN TV PICTURE TUBES

CROSS REFERENCE TO RELATED PATENT APPLICATION

This application discloses apparatus described and claimed in copending application Ser. No. 927,246, filed July 21, 1978 now U.S. Pat. No. 4,172,309, of common ownership herewith.

BACKGROUND OF THE INVENTION AND PRIOR ART DISCLOSURE STATEMENT

This invention relates to improved electrodes for unitized electron guns used in television cathode ray tubes, and is particularly concerned with means and method for compensating for beam spot distortion introduced by certain cathode ray tube components.

Optimum resolution is a much desired and sought after characteristic in television picture tubes. Resolution is largely a function of the size and symmetry of the beam spots projected by the electron gun of the picture tube, or guns in plural-beam tubes. Beam spots are desirably relatively small, symmetrically round, and uniform in size at all points on the picture screen. Achievement of these ideals has been difficult because of the many factors which influence the configuration of beam spots. As a result of these factors, a beam spot that is symmetrical at the center of the picture imaging field can become distorted at the periphery of the field, as will be shown.

The key factors which influence beam spot configuration and symmetry of picture tubes having three-beam unitized electron guns include electron gun design, cathode ray tube screen potential, magnitude of beam current, the "throw" distance from the electron gun to a given point on the screen, and the convergence means. Of these, distortion of the beam spot configuration induced by the electron gun mechanical design and the magnetic convergence means are most relevant to problems resolved by the present invention.

The term commonly applied to the phenomenon of center-screen-to-side distortion is "deflection defocusing." The effect of deflection defocusing when a self-converging yoke is employed for beam deflection is shown diagrammatically by FIG. 1, wherein a cathode ray tube faceplate 10 is shown as having a luminescent screen 12 indicated schematically by the peripheral dashed line. A beam spot 14 is shown as being symmetrically round when at its landing point at the center 16 of screen 12. At the periphery of the screen 12, however, the beam spot is shown to be everywhere elliptized, as indicated by beam spots 18, with the major axes of the ellipses directed toward the screen center 16. (The effect shown applies to a gun designed such that the focus track will not allow operation of the beam in a core/halo mode as deflection takes place.)

A major cause of deflection defocusing is attributable to the design of the yoke. Asymmetrical center spots are largely attributable to gun design. In a gun having lens electrodes made up of continuous tubes, or "barrels," there is negligible distortion of the beam.

This effect is shown schematically by FIG. 2 wherein an electron beam 20, as seen from a viewpoint concentric with its axis, is indicated as passing through a continuous cylindrical lens element 22 (beam-passing tube). Beam 20 is subject to the influence of electrostatic forces which are radially equal, as indicated by equal-length arrows 24. This electrode structure leads to the projection of a symmetrically round beam spot 26 on the screen.

In in-line guns structured without beam-passing tubes, however, the beams are subject to asymmetric influences resulting in distortion of the beam spots. This effect is shown schematically by FIG. 3 wherein a rectangular metallic electrode 28 is indicated as having three beams 30, 32 and 34 passing therethrough. With regard to beam 32 (normally the beam of the "green" gun), the beam, unlike beam 20 of FIG. 2, is subject to an unequal division of forces. The metal of electrode 28 in the shape of a rectangle that forms an apparent lens similarly rectangular that subjects the beam to "pulling" forces, indicated by the outwardly directed arrows lying in the minor axis of rectangular electrode 28, and at the same time, to "pushing" forces, indicated by the inwardly directed arrows lying in the major axis. These forces lead to beam spots having either of the elliptical configurations shown by beam spots 36 and 38. Whether the major axis of the elliptical beam spot lies in the horizontal plane or in the vertical plane depends upon factors such as whether or not the immediate lens action is positive or negative, and whether or not the beam is being accelerated or decelerated.

Beams 30 and 34, lying near the sides of electrode 28, are subject to different force vectors; the forces are even more unbalanced because of the propinquity of the beams to one of the ends of electrode 28 and in remoteness from the opposite end. As a result, the beam spots will be substantially asymmetric but basically elliptized as indicated by spots 36 and 38. But rather than the very symmetrical ellipses shown, the spots will be more of a configuration resembling a tear drop, as indicated by beam spot 40 produced by beam 30, and beam spot 42 produced by beam 34.

The components that provide both static and dynamic magnetic convergence can similarly distort beam spots at the periphery of the screen. Static convergence is commonly provided by quadrupolar and sextipolar magnetic fields, and dynamic convergence by the "self-converging" yoke now in common use in conjunction with in-line guns in color television picture tubes.

Static convergence of the electron beams, and the adjustment of the "color purity" of reproduced images is provided by an assembly of circumferential magnets located around the neck of the cathode ray tube in the areal region of the main focus lens of the electron gun. Such an assembly is illustrated by FIG. 4, shown in association with a color cathode ray tube display of the self-converged type. Briefly, the illustrated system comprises a tube envelope 44 on the neck 46 of which is mounted a magnetic yoke assembly 48, the color purity/static convergence assembly 50, and a printed circuit board assembly 52. The forward part of the envelope 44 is broken open to show the CRT faceplate 54, a phosphor screen 56 on the inner surface of the faceplate 54, a shadow mask 58 spaced from the screen, and three coplanar "in-line" electron beams 60, 62 and 64 generated by an electron gun assembly (not shown) in the neck 46 of the tube. Also shown on the tube is a bundle of yoke leads 68 and a high-voltage connector 70 through which the anode voltage is brought through the tube envelope for application to the screen 56. A base for the tube is shown at 72.

To effect static convergence of the beams, and to adjust the "color purity" of the reproduced images, the purity/static convergence assembly 50 comprises three components: a bi-polar purity adjustment component 74, and quadrupolar and sextipolar static convergence adjustment components 76 and 78. A ring-gear drive arrangement is provided for the convergence adjustment components 74, 76 and 78 so that they can be driven in the desired rotational directions when an associated drive gear is turned. As related pairs of multipolar magnets are contra-rotated, their respective fields either align or cancel, permitting a resultant magnetic field of any desired strength to be obtained. Thus, by appropriate control of the relative rotational positions of the magnets, the three in-line electron beams can be shifted in unison from side-to-side to effect purity control, and, by means of components 76 and 78 which comprise the quadrupolar and sextipolar magnets, each beam can be moved relative to the other to effect convergence of the beams on the screen. The purity/static convergence assembly 50 is disclosed in detail and fully claimed in U.S. Pat. No. 4,050,041, assigned to the assignee of the present application.

While providing the benefits of static convergence and purity control, the quadrupolar adjustment component 76 of assembly 50 exerts a deleterious effect on the configuration of the beams passing through its field of influence. The effect is illustrated schematically in FIG. 5 wherein the electron beams 60, 62 and 64 of an in-line gun are shown as being surrounded by the quadrupolar field 80, indicated by the dashed lines, of the quadrupolar static convergent adjustment component 76 shown by FIG. 4. The polarities of the quadrupolar field 80 are indicated by the positive and negative symbols. The effect of the quadrupolar field 80 is shown by the adjacent series of beam spots, wherein beam spot 62*a* of beam 62 is shown as being elliptically distorted. The distortion of off-center beams 60 and 64 as indicated by the beam spots 60*a* and 64*a* wherein the spots are shown to be irregular ellipses skewed inwardly toward the center beam 62, also as a result of the distortive influence of quadrupolar field 80.

Another of the convergence components that produces beam spot distortion in deflection is the self-converging yoke field. Yoke assembly 48 (FIG. 4) is a hybrid type having toroidal-type deflection vertical coils and "saddle-type" horizontal deflecting coils. The yoke is of the self-converging type and contains windings which produce an astigmatic field component having the effect of maintaining the beams in convergence as they are swept across the screen. The astigmatic field component which self-converges the beams, however, undesirably introduces an astigmatic deflection defocusing of the beams when the beams are deflected off the tube axis. Since spherical aberration cannot be eliminated entirely, but only minimized, and since the yoke astigmatisms are necessary if self-convergence is to be achieved, it is difficult if not impossible to completely "design out" this deflection defocusing problem.

However, an acceptable compromise can be effected. Beam spot ellipticity at the screen periphery, wherein the major axis of the ellipse is in the horizontal plane, can be reduced and its effects alleviated by causing the beam spot at its landing point at the center of the screen to be elliptical in the vertical plane. As the beam is deflected, the same phenomenon that causes the undesired peripheral ellipticization works to make the center-ellipticized beam spot round at some distance between the screen center and its periphery, and relatively round at the screen periphery. The penalty of vertical beam spot ellipticity at the center of the screen is minimal in line-screen type cathode ray tubes in common use. Any loss in resolution at the center is more than compensated for by the greatly increased resolution in the non-central zones resulting from the relatively round beam spots.

Various approaches have been taken to reduce the real or apparent effects of deflection defocusing of the beams at the screen peripheries. One approach is described in U.S. Pat. No. 3,984,273. It involves the provision of vertically oriented elliptical apertures in the G2 electrode of the gun. The resulting beam spot shape is vertically elliptical at the screen center; that is, a shape that is orthogonal to the horizontal beam deflection defocusing produced by the factors described in the foregoing. Some compensation for deflection defocusing is attained; however, there are a number of drawbacks to this approach. It is believed for example that the amount and perhaps even the direction of the ellipticity induced in the beam changes as a function of beam current; hence this "elliptized aperture" approach is relatively ineffectual. Second, the use of such a gun is limited to a given design to conform to a particular cathode ray tube size and configuration. Also, it is well known that any gun having apertures which are not rounded is difficult and costly to assemble. Electron guns having round apertures are assembled by the well known technique of "mandrelling" the parts and thereafter conjoining the parts by the use of heat-softened glass rods. Electrodes having non-cylindrical apertures cannot be precisely aligned on rod-like mandrels designed for circular apertures. Another example of this approach is found in U.S. Pat. No. 3,881,136.

Another approach involves forming a round beam in the lower end of the gun, as is conventional. In the main focus lens of the gun, a quadrupolar astigmatic field component is formed which introduces a vertical elongation of the beams at the screen center. The vertical elongation attained at least partially compensates for deflection defocusing of the beams. This technique is employed in a non-standard color CRT display system in which three electron guns are arranged to share a common main focus lens. A dynamic quadrupolar magnetic field is established in the main lens which rounds out the beams. This system is described in an article titled "25-Inch 114 Degree Trinitron Color Picture Tube And Associated New Development," Sony Corporation, IEEE Spring Conference on BTR, June 10, 1974.

This latter-described system offers the advantage of producing no astigmatism in the beam when the yoke field is zero; that is, when the beams are in the center of the screen. It has the disadvantage, however, that in rounding out the beams at the edges of the screen, the beam spots are undesirably enlarged. It has been found to be necessary in such a system to use relatively costly dynamic focusing along with deflection defocusing compensation in order to minimize the spot enlargement at the screen edges. Dynamic focusing is normally not needed in modern-day color television receivers.

U.S. Pat. No. 4,086,513 to Evans, Jr. discloses a plural gun cathode ray tube having parallel plates, or "extensions," adjacent to grid apertures of a bipotential electron gun. The stated objective is to distort the electrostatic field formed by at least one of the two electrodes nearest the screen, forming noncircular electron beams to compensate for distortion of the beams in the magnetic deflecting field. In one embodiment, plates are positioned on opposite sides of each aperture and extend toward the screen from one of the focusing electrodes, resulting in vertical elongation of the undeflected beam spot. In another embodiment, horizontally oriented parallel slats or plates are attached to the inner wall of a cup-shaped accelerating and focusing anode to cause defocusing about the vertical axis passing through the electrode apertures. The result is also vertical elongation of the beam spot. Electrodes according to the Evans, Jr. disclosure are characterized by the creation of a circularly symmetrical field which is deliberately distorted by the extending plates or slats to obtain the desired beam spot ellipticity. Further, the gap between the electrodes is constant, and the extensions are common to the entire electrode. The drawback to the use of such extensions include the problems in production in producing such a complex structural addition, and, in the embodiment wherein the slats project into the gap, the problem of inter-electrode arcing induced by the extensions.

OBJECTS OF THE INVENTION

It is a general object of the invention to provide improved performance in plural-beam, unitized in-line electron guns used in color cathode ray picture tubes.

It is another general object to provide improved performance in such electron guns by improving resolution through a reduction in beam spot distortion.

It is a less general object to provide means for correcting the form of distortion known as deflection defocusing introduced by cathode ray tube components.

It is a more specific object of the invention to provide means for correcting for deflection defocusing introduced by the color purity/static convergence assembly and the self-converging yoke.

It is yet another specific object to provide practical, low-cost means for at least partially compensating for undesired distortion of beam spots, and without radically altering gun structure.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

Figure 1:
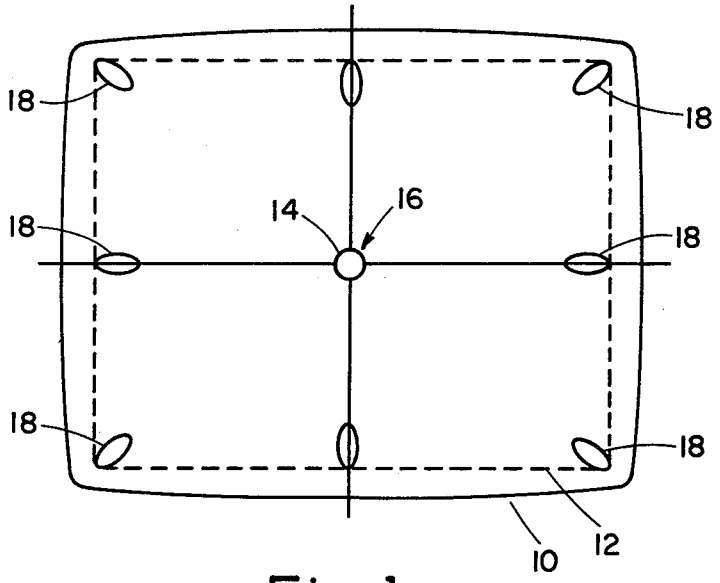
Fig. 1 PRIOR ART
FIG. 1 shows diagrammatically the distortion of a beam spot on a television screen caused by deflection defocusing.
Figure 2:
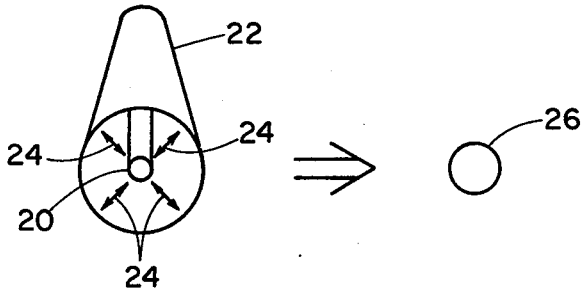
Fig. 2 PRIOR ART
FIGS. 2 and 3 show diagrammatically the effect of differences in electrode structuring on the configuration of beam spots.
Figure 3:
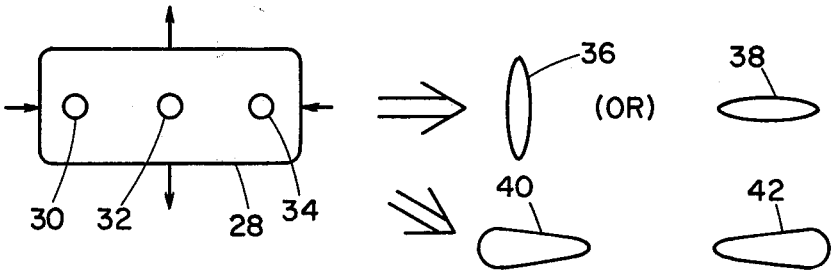
Fig. 3 PRIOR ART
Figure 5:
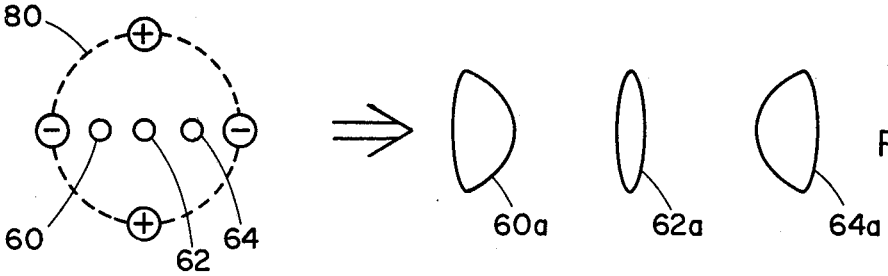
Fig. 5 PRIOR ART
FIG. 5 shows diagrammatically the distortive effect on beam spot configuration of the color purity/static convergence means.
Figure 4:
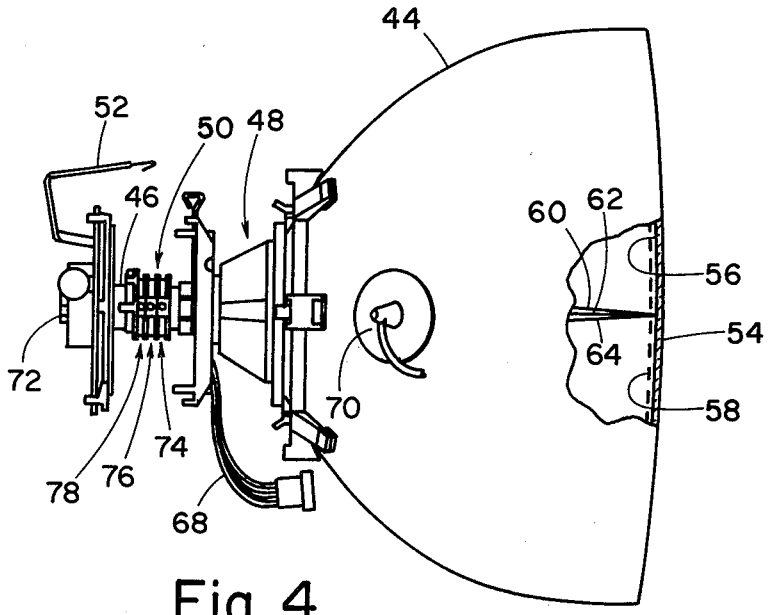
Fig. 4 PRIOR ART
FIG. 4 is a plan view partly broken away of a color cathode ray tube display system.
Figure 6:
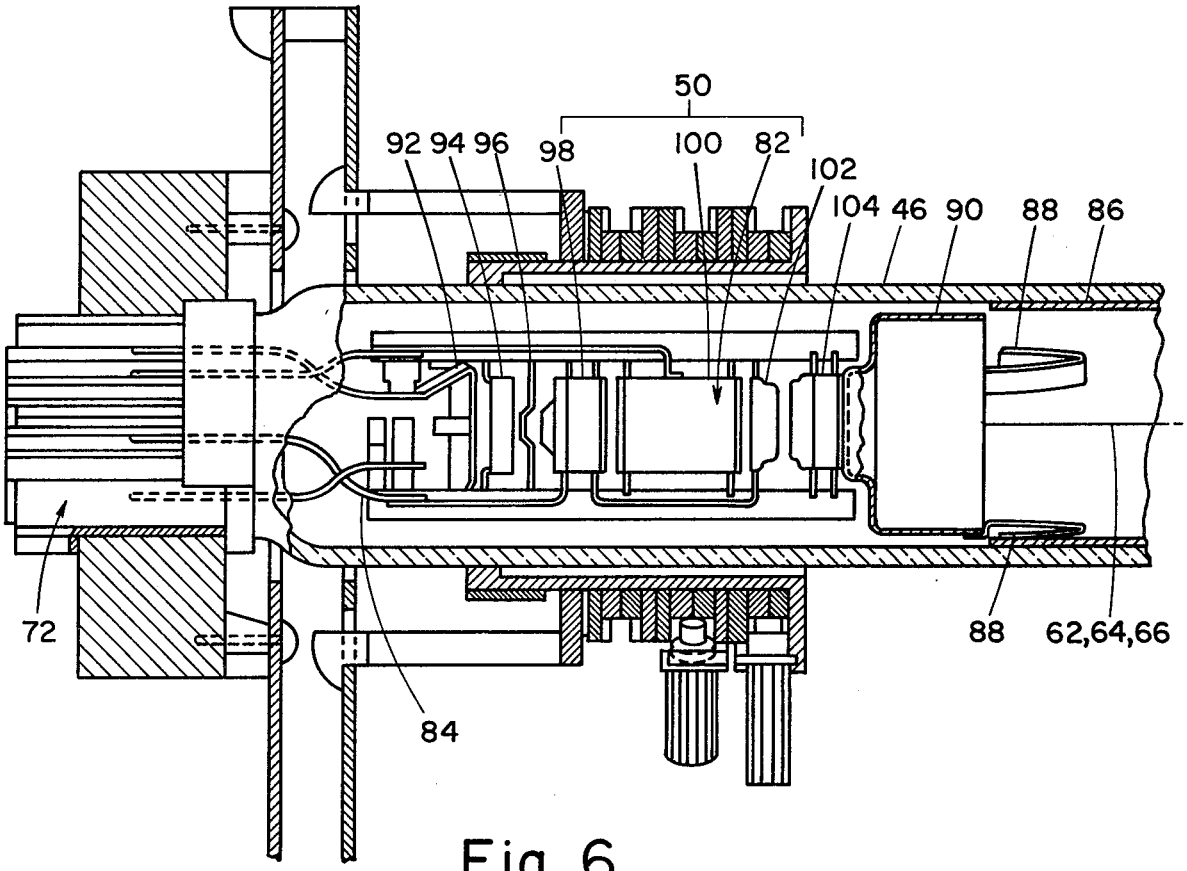
Fig. 6 PRIOR ART
FIG. 6 is an enlarged fragmentary sectional view of a neck portion of the FIG. 4 tube, showing otherwise hidden internal components.

FIG. 6 will be recognized as comprising the neck and base portion of the color cathode ray tube display of the self-converged type shown by FIG. 4 and as described in connection with FIG. 4. Enclosed in neck 46 is an electron gun 82 which may be any of a variety of types but is here shown as being a high-performance gun manufactured and sold by the assignee of the present invention and fully disclosed and claimed in U.S. Pat. No. 3,995,194 to Blacker et al. The illustrated embodiment of the gun 82 is a unitized, in-line type gun that generates three coplanar beams 60, 62 and 64, (shown edge-on) each of which is formed, shaped and directed by electron gun 81 to project three beam spots on the picture imaging screen, to selectively energize the aforedescribed pattern of phosphor elements. Base 72 provides a plurality of lead-in pins for introduction into the evacuated envelope of the tube the television video and sync signals, as well as other voltages for operation of the gun 82. A power supply (not shown) develops a predetermined pattern of low, medium and high voltages for application to the electrodes of gun 82 through a plurality internal electrical conductors, typified by conductor 84, the plurality of leads are interconnected in turn to a plurality of lead-in pins in base 72. The external power supply also supplies a high voltage; e.g., about 30 kilovolts to a thin coating of electrically conductive material 86 deposited as shown on a portion of the inner surface of neck 46. The high voltage of this coating is picked up by a plurality of snubber springs 88, two of which are shown, which serve two purposes: one is to center the forward end of electron gun 82 within neck 46; the other purpose is to conduct the high potential on conductive coating 86 to shield cup 90. Shield cup 90 is physically and electrically connected to the final focus electrode 104 of electron gun 82.

The components of electron gun 82 consist of a plurality of differently electrically charged electrodes having facing sections comprising juxtaposed walls with coaxially aligned openings therethrough for passage of the beams. The walls define at least one gap in which is established a beam-focusing electrostatic field. The electrodes of electron gun 82 consist of lower-end electrodes; that is, the electrodes proximate base 72 comprising the heater-cathode assembly 92 which provides for generation of the electron beams; first grid electrode 94 and a second, disc-type grid electrode 96. The purpose of the lower-end electrodes is to generate three separate beam cross-overs (not shown), one for each of the coplanar beams.

The three beam cross-overs are imaged on the screen of the cathode ray tube by the main focus lens electrodes which constitute the "upper end" section of gun 82, that is the end proximate the faceplate. The main focus electrodes comprise electrodes 98, 100, 102, and 104; electrode 104 is the aforementioned final focus electrode. Each of the main focus lens electrodes is electrically isolated from the others and each is differently electrically charged with a predetermined voltage from the power supply to form a single extended main focusing electrostatic field.

Typical potentials of the unitized, in-line gun shown by FIG. 6, and used for exemplary purposes in the description of the invention, may for example, be as follows: First grid electrode 94 may for example be at ground potential, while the potential of the unitized second electrode 96 may be one kilovolt. The approximate potentials on the electrodes 98, 100, and 102 may be respectively (in kilovolts) 12, 7, and 12. The potential of final focus electrode 104 is the same as the potential on the inner conductive coating 86; that is, about 30 kilovolts. The spacing between electrodes 98, 100, 102, and 104 may be approximately 40 mils. As noted, each electrode has three openings therethrough for the passage of the three beams; the openings for each beam are coaxially aligned.

It is of interest to understand that most in-line type electron guns (the gun assembly 82 included) provide for beam convergence. In the illustrated gun assembly 82, the last two electrodes of the main focus lens, here labeled electrodes 102 and 104, are structured such that the gap therebetween in the regions where the outer electron beams pass through, is skewed slightly with respect to the other inter-electrode gaps in the gun. This skewing of the 102–104 gap produces an asymmetrical field component which bends the outer beams inwardly to produce the desired nominal convergence of the three beams at the screen. This structure for the converging of electron beams is described fully and claimed in U.S. Pat. No. 4,058,753, assigned to the assignee of the present application. By virtue of the gun assembly 82 providing beam convergence, the amount of static beam convergence adjustment which must be provided by the static convergence adjustment components hereto foredescribed is vastly reduced.

Figure 7:
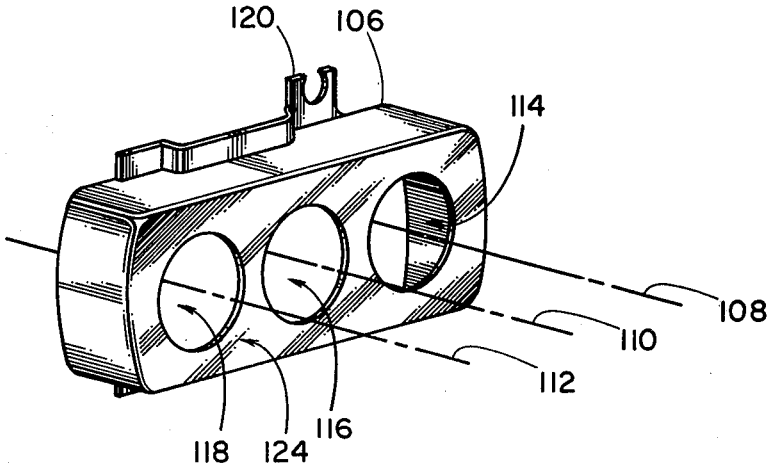
Fig. 7 PRIOR ART
FIG. 7 is a view in perspective of a typical focus lens electrode of a three-beam utilized in-line electron gun.

FIG. 7 is a view in perspective of a typical electrode element 106 of a main focus lens resembling, for example, the electrode element 102 shown by FIG. 7. Three beams 108, 110 and 112 are shown as passing through opening 114, 116 and 118 respectively; the openings are coaxially aligned with openings in associated electrodes (not shown). Claw 120 is for attachment to a multiform bead (also not shown) providing for conjoining of the electrodes of the electron gun, as is well known in the art.

Figure 8:
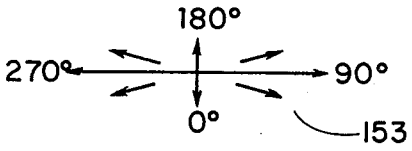
Fig. 8 PRIOR ART
FIG. 8 is an elevational view in section of the electrode of FIG. 7, shown schematically, in association with a juxtaposed electrode.
Figure 8:
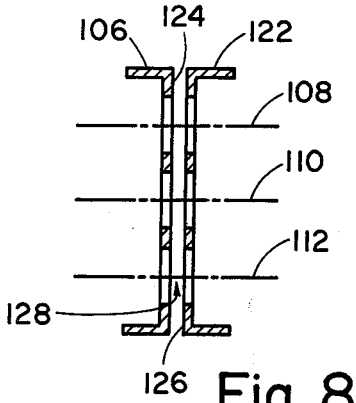
Fig. 8 PRIOR ART

FIG. 8 shows in section electrode 106 in association with a differently electrically charged electrode 122. The wall 124 of electrode 106 is juxtaposed to wall 126 of electrode 122 defining a gap 128 in which is established a substantially azimuthally symmetrical electrostatic field.

Figure 9:
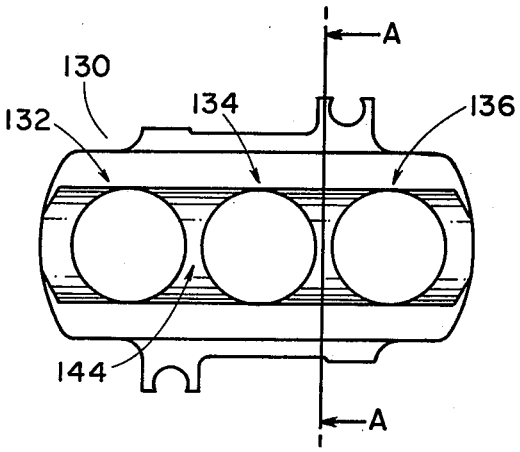
FIG. 9 is a plan view of a unitized electrode for a three-beam gun according to the invention.

FIG. 9 is a plan view of a unitized electrode 130 for a three-beam electron gun according to the invention. The electrode walls 132, 134 and 136 are indicated as being mechanically deformed in the perimeter of each opening 138, 140 and 142. The mechanical deformation 144 in the perimeter of each opening common to each wall is indicated graphically by the shading lines as being "trough-like" for exemplary purposes. It is to be noted that the amount of distortion shown has been greatly exaggerated for illustrative purposes in this and all other illustrations showing such deformations according to the invention.

The mechanical deformation in the opening perimeter according to the invention falls within the purview of the Webster Dictionary definition of deform ". . . to become misshapen or changed." In this context, an electrode that is otherwise formed to be dimensionally symmetrical in the opening perimeter to cause the associated electrostatic field to be azimuthally symmetric is deliberately deformed or misshapened in the opening perimeter according to the invention to cause the associated electrostatic field to be azimuthally asymmetric about the opening.

Figure 10A:
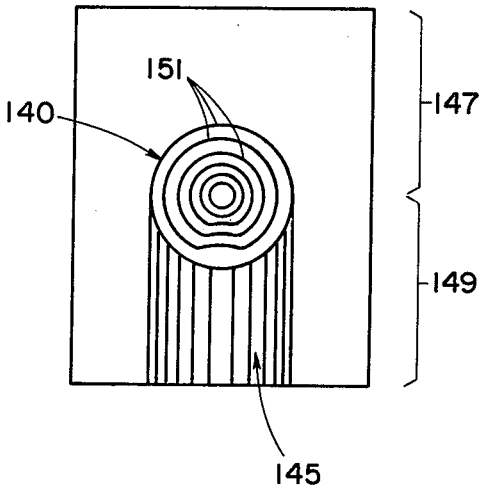
FIG. 10A is a view in elevation of an electrode and the opening therein showing graphically an effect of the application of the invention.
Figure 10:
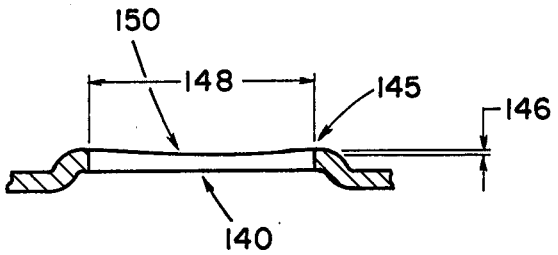
FIG. 10 is an elevational view in section of a configuration of an electrode wall representing an embodiment of the invention.

The profile of a mechanical deformation in an opening perimeter according to the invention, which as noted is shown in this example as being a depression 145 in the form of a shallow trough, is indicated by FIG. 10, which is a section taken along lines A—A of electrode 130 of the foregoing FIG. 9. The depth 146 of the depression may be, by way of example, in the range of 0.0005 to 0.006 inch, and preferably is less than 0.0015 inch. The diameter 148 of the circle formed by the perimeter of the opening 140 is by way of example 0.150 inch, and the radius 150 about the perimeter of opening 140 as indicated by the arrow is preferably a smooth bend in all directions from the center of the opening.

The effect of a mechanical deformation in the opening perimeter according to the invention on the electrostatic field is indicated diagrammatically by FIG. 10A, which comprises in part a plan view of the section A—A of FIG. 9 shown by FIG. 10. To highlight the effect of the electrostatic field, the wall of the electrode has been arbitrarily partitioned into an undeformed section 147 and a section 149 (both indicated by brackets) mechanically deformed in the perimeter of the opening 140 according to the invention. The deformation is shown as being a depression 145 in the form of a shallow trough.

The effect on the field in opening 140 is shown by the equipotential lines 151 wherein the electrostatic field, as indicated by the equipotential lines, is shown as being asymmetrical about the opening 140 in the vicinity of the depression 145. The magnitude of the asymmetry is a function of the depth (or height) of the mechanical deformation, which varies according to the "azimuth" of the opening (indicated by the associated compass card 153). The influence of the mechanical deformation causes the electrostatic field to be azimuthally asymmetrical according to the invention. The effect on the beam spot depends upon the influence of several factors denoted in connection with the forthcoming discussion of the embodiments of the invention shown by FIGS. 13 and 14.

Alternatively, and all in accord with the invention, the mechanical deformation in the opening perimeter may comprise the protrusion. This configuration is indicated by the electrode cross-section shown by FIG. 11. The height 152 of the protrusion, may be in the range of 0.0005 to 0.006 inch, and preferably, has a maximum heighth of 0.0015 inch. The diameter 154 of the circle formed by the perimeter may be, for example, 0.150 inch, and the radius 156 is preferably a smooth blend in all directions as indicated by the arrow.

Figure 12:
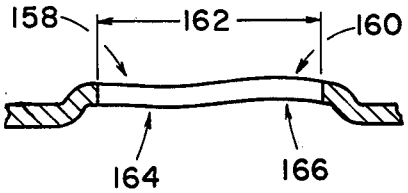

Further, the mechanical deformation in the opening perimeter of an electrode according to the invention may comprise the combination of a depression 158 and a protrusion 160 as indicated by FIG. 12; the combination is bounded by the circle, the diameter 162 of which is 0.15 inch, for example. The heighth of the protrusion 160 may be, for example, 0.0005 inch, and the depth of the depression 158 may also be 0.0005 inch; the peak-to-peak separation is then preferably 0.001 inch. A peak-to-peak separation in the range of 0.001 to 0.012 inch is feasible.

The very small dimensions cited; viz. a depth of 0.0005 inch, preferably, for a typical depression, points up a salient fact of the invention. The magnitude of the mechanical deformation in the opening perimeter according to the invention is very slight, and in many cases so slight as to be imperceptible to the unaided human eye. Yet the effect of the distortion, subtle though it may be, has an unexpected, surprising effect in its ability to act on a beam in a sense tending to at least partially compensate for undesired distortion of beam spots.

Figure 11:
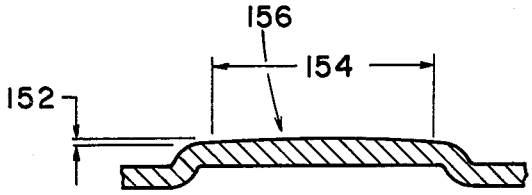
FIGS. 11 and 12 are elevational views in section of configurations of electrode faces representing embodiments of the invention.

It will be observed also in the electrode structure shown by FIGS. 10 and 11 that the "back" wall; e.g., the side opposite the wall exhibiting the depression or protrusion or combination thereof, is shown as being flat. The contour of the back wall can be flat or it could as well conform to the contours of the mechanical deformation in the opening perimeter on the "front" wall of the electrode. This aspect is indicated by FIG. 12 wherein area 164 indicated by the arrow is in conformance with the front wall depression 158, and area 166 is in conformance with protrusion 160.

The influence on the contour of a beam spot by the mechanical deformation of an electrode in the opening perimeter according to the invention is dependent upon several factors including (a) The configuration of the deformation, whether it be depression, a protrusion, or a combination thereof;

(b) The dimensions of the deformation(s);

(c) The deformation(s), if any, of the opposite wall of the adjacent electrode; and its relation to its counterpart;

(d) The width of the gap between the electrodes;

(e) The amount of beam filling in the vicinity of the electrode wall so deformed;

(f) The rate of change of axial potential in the vicinity of the electrode wall;

(g) The magnitude of beam direction change.

Figure 13:
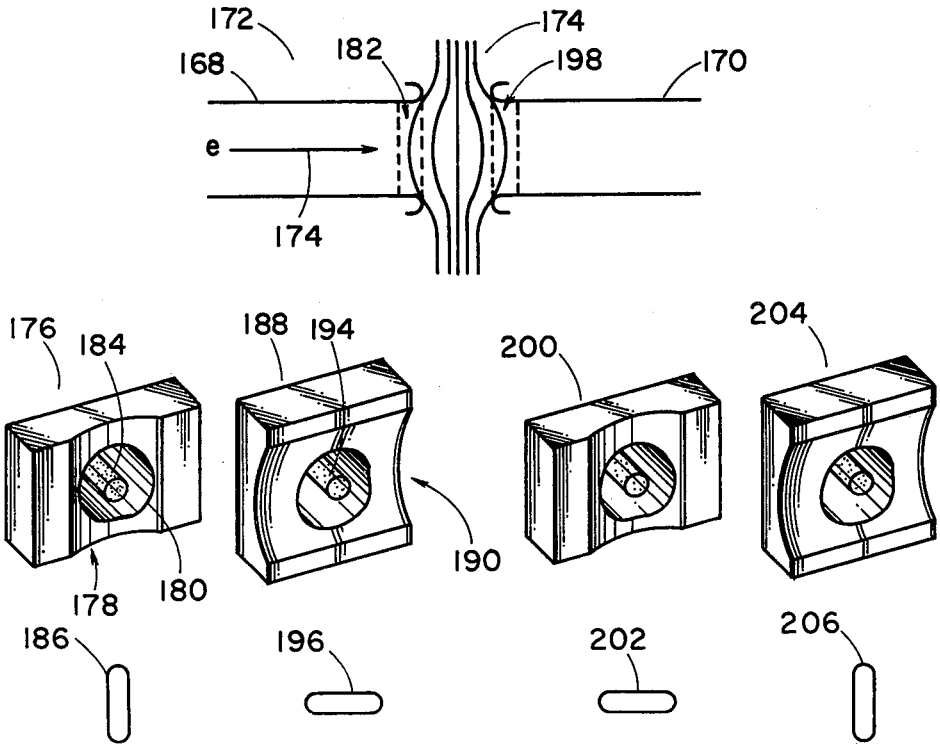
FIG. 13 indicates the influence on the contours and orientation of beam spots by various electrode configurations according to the invention.

The influence on beam spot contours of electrode faces mechanically deformed in the opening perimeter is indicated diagrammatically by FIG. 13. Again, and as noted heretofore, the amount of deformation shown is greatly exaggerated for illustrative purposes. Two differently electrically charged electrodes 168 and 170 of a main focus lens 172 of a bipotential electron gun for example, may have potentials thereon of five kilovolts and 30 kilovolts, respectively. The equipotential lines of the beam-focussing electrostatic field 174 are indicated. The gradient in potential between electrodes 168 and 170 provides a field that accelerates electrons e comprising the beam as indicated by arrow 174.

Electrode section 176 is represented for exemplary purposes as having a "trough-like" mechanical deformation 178 (greatly exaggerated for illustrative purposes) whose axis is vertically oriented in the perimeter of opening 180 of electrode section 176; this electrode should be considered for exemplary purposes as occupying the "wall" of electrode 168, the wall being indicated by the dash line area 182. A round electron beam 184 is indicated as passing through electrode section 176.

The influence of the trough-like mechanical deformation in the opening perimeter 180 of electrode section 176 is indicated by beam spot 186, shown as being "stretched" in a vertical orientation.

The influence under different circumstances of mechanical deformation in the perimeter opening according to the invention is indicated by electrode 188, which can be considered alike unto electrode 176 in all other respects except that the mechanical deformation in the opening perimeter 190 (again shown greatly exaggerated for illustrative purposes) comprises a "trough" the axis of which is horizontally oriented, as shown. The influence of the mechanical deformation on a round beam 194 passing therethrough is indicated by beam spot 196, wherein the beam spot is shown as being stretched in a horizontal direction.

An inverse effect on beam spot contour takes place when the electrodes having the mechanical deformation indicated by electrode sections 176 and 188 are installed by way of example in the wall area 198 of electrode 170, which has a potential of about 30 kilovolts thereon. Electrode section 200, which should be considered as occupying face area 198, is indicated as being the same in configuration as electrode section 176, with a vertically oriented deformation. However, when this electrode of identical configuration and orientation is installed in space 198 facing electrode 172, it will produce a beam spot 202 which is stretched in a horizontal direction, as opposed to the vertically stretched beam spot 186 produced by electrode 176; similarly, electrode section 204 indicated as being identical in configuration and orientation to electrode section 188, when in wall area 198 and opposite to electrode 168, produces a beam spot 206 stretched in a vertical direction.

Figure 14:
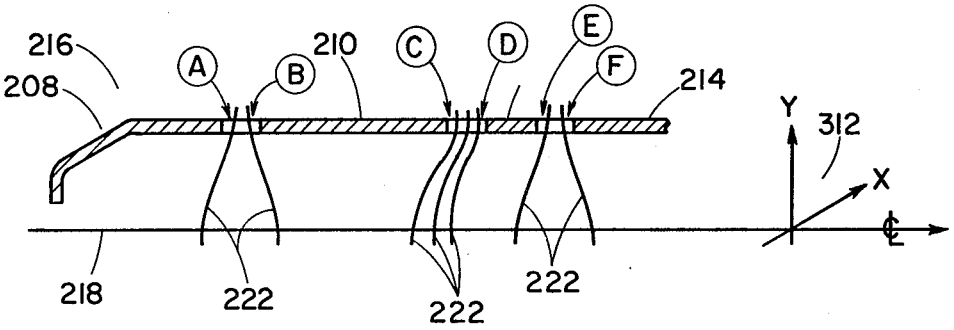
FIG. 14 is a diagrammatic representation of the main focus electrodes of an extended field lens referenced to an associated table defining beam spot orientation in relation to electrode deformation; and, FIG. 15 is a view in perspective of an electrode configuration representing yet another aspect of the invention.

As noted, many factors influence the effect on beam spots by the mechanical deformation according to the invention. The effect of a key factor—the rate of change of axial potential in the vicinity of the electrode face having a mechanical deformation—is indicated by FIG. 14 and associated Table A. Four electrodes 208, 210, 212 and 214 of a main focus lens 216 are shown as lying upon an axis 218. The orientation of the beam spots, whether in the X, or horizontal axis; or in the Y, the vertical axis, as a result of the influences to be described in the following, is indicated by the compass 312. Because adjacent ones of electrodes 208, 210, 212 and 214 are differently electrically charged, electrostatic fields exist between them, as indicated by the equipotential lines 222. The potentials on the electrodes in kilovolts may be, for example: 12 kV on electrode 208, 7 kV on electrode 210, 12 kV on electrode 212, and 32 kV on electrode 214. As a result, the field between electrodes 208 and 210 is a decelerating field, and the electrons passing therethrough are slowed; while the increasing gradient of the axial potential distribution on electrodes 210, 212 and 214 (7.5 kV, 12 kV and 32 kV), accelerates the electrons passing therethrough. The area of electron deceleration is indicated by the arrow 224, and the area of electron acceleration is indicated by arrow 226. The effect of the electron-optical lens developed between electrodes 208 and 210 on a beam passing through the decelerating field is a diverging action. The effect of the lens between electrodes of the accelerating field exerts a converging effect on the beam passing therethrough.

Table A indicates the effect on the orientation of the beam spots, whether in the X-horizontal axis or the Y-vertical axis as a function of locations, (A,B,C, etc.) the type of deformation, whether depression or protrusion, and X-Y orientation of each mechanical deformation in the opening perimeter of the associated electrode. (The deformation is considered to be trough-like, by way of example.)

So the orientation of a beam spot, whether "stretched" in a horizontal direction or in a vertical direction, is primarily a function of (1) whether the beam is entering an accelerating field or a decelerating field, (2) whether the electrostatic field (indicated by the right or left curvature of the equipotential lines) is diverging or converging, and or (3), whether the mechanical deformation in the opening perimeter according to the invention comprises a depression or a protrusion.

TABLE A

| LOCATION | LENS ACTION | X-DIRECTED DEPRESSION | Y-DIRECTED DEPRESSION | X-DIRECTED PROTRUSION | Y-DIRECTED PROTRUSION |
|---|---|---|---|---|---|
| A | DIVERGENT | VERTICAL | HORIZONTAL | HORIZONTAL | VERTICAL |
| B | CONVERGENT | HORIZONTAL | VERTICAL | VERTICAL | HORIZONTAL |
| C | CONVERGENT | HORIZONTAL | VERTICAL | VERTICAL | HORIZONTAL |
| D | CONVERGENT | HORIZONTAL | VERTICAL | VERTICAL | HORIZONTAL |
| E | CONVERGENT | HORIZONTAL | VERTICAL | VERTICAL | HORIZONTAL |
| F | DIVERGENT | VERTICAL | HORIZONTAL | HORIZONTAL | VERTICAL |

Experience in the design and manufacture of electrodes having mechanical deformations in the opening perimeters according to the invention has shown that the determination of the extent, configuration, dimensions and orientation of the deformation is best arrived at empirically. The requirement for such empiricism will be no impediment to one skilled in the art of cathode ray tube electron gun design having access to the standard laboratory equipment and fixtures used in the art and practice of gun design.

The effect of the mechanical deformation about the opening perimeter in at least one of the electrode walls according to the invention will be strongest where the electrostatic field is strongest. In a three-beam bipotential electron gun, for example, wherein the main focus lens has two electrodes with a strong field therebetween, one or more of the juxtaposed electrode walls would be mechanically deformed according to the invention to exert maximum compensatory effect on the contours of the beam spots projected by the gun.

In an electron gun having more than two electrodes such as, for example, the four-electrode main focus lens of the extended field lens electron gun according to U.S. Pat. No. 3,995,194, assigned to the assignee of this invention, the strongest field exists between the anode electrode 104 and the adjacent electrode 102 (please refer to FIG. 6). Because of the strong field between electrodes 102 and 104, at least one of the electrode walls would preferably be mechanically deformed according to the invention.

It is to be noted that the invention is not limited to location in the strongest inter-electrode field, nor to the weakest. Neither is the application limited to an electrode of the main focus lens of the electron gun. Electrode walls may be mechanically deformed according to the invention at any beneficial inter-electrode location in the cathode ray tube electron gun.

The prime benefit of the invention is that it provides means for compensating, in a substantial measure, for many types of beam spot distortion. One example is the distortion that has its origin in the absence of internal beam-passing tubes in electron guns having cup-like electrodes. Another example is the beam spot distortion attributable to components intended to induce convergence of plural beams, such as the self-converging yoke. The benefit can be summed up precisely by the statement that the means and method according to the invention provides for correcting distortion by "compressing that which has been stretched and stretching that which has been compressed."

Figure 15:
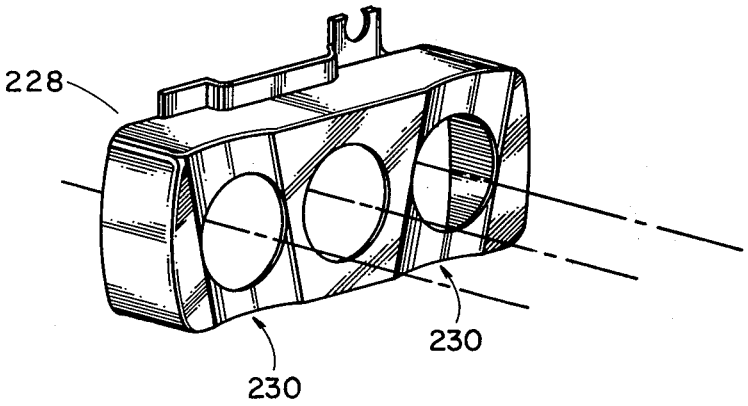

The mechanical deformations of electrodes according to the invention are not limited to the configurations and orientations shown by the aforedescribed examples, but may take many other forms, the number and utility of which is limited only by the ingenuity and specific needs of the gun designer. A representative example is shown by FIG. 15 wherein an electrode 228 of a three-beam unitized electron gun is shown as having mechanical deformations 230 in the perimeters of the openings; these deformations are illustrated as comprising trough-like depressions whose axes are at angles one to the other. It is also within the scope of the invention that a juxtaposed wall of an associated electrode (not shown) may have deformations which are mirror-images to deformations 230 or, the deformations of the juxtaposed wall may comprise troughs whose axes at are contrary angles to the axes of deformations 230—two of such juxtaposed walls mechanically deformed according to the invention can mutually interact to cause the electrostatic field therebetween to be desirably azimuthally asymmetrical.

Further, it is also well within the purview of the invention that the mechanical deformations are not limited to the trough-like depressions shown for exemplary purposes, but may comprise any other shape deemed to be efficaceous by one skilled in the art utilizing the invention. For example, the mechanical deformation in the opening perimeter of an electrode may be selected from a group consisting of a notch, a rosette, a cruciform, an ellipse, a square, or a circle.

The method for at least partially compensating for an undesired distortion of a beam spot according to the invention comprises designedly mechanically deforming in the perimeter of the opening at least one electrode wall to cause the electrostatic field to be azimuthally asymmetrical about the opening. Further, the juxtaposed walls of at least two of the electrodes may be designedly mechanically deformed in the perimeters of the openings to mutually cause the electrostatic field to be azimuthally asymmetric about the openings.

Electrodes for electron guns used in cathode ray picture tubes are customarily formed by dies in which the parts are formed by progressive drawing and stamping. Electrodes are commonly fabricated from, for example, stainless steel ASAI type 305 strip having a Rockwell hardness of B80 and an initial thickness of 0.010 inch (0.25 mm). Methods for forming electrode parts having desired mechanical deformations according to the invention will be readily apparent to those skilled in the art in precision tool and die making of electron gun parts, where tolerances are commonly held to tenths of thousands of an inch. The necessary tolerances prescribed for the deformation according to the invention can be attained without undue experimentation. The deformations, for example, can be introduced at an early stage in the progressive die stamping process. Or, the finished parts can be suitable deformed according to the invention by well-known means as a final operation. Other means for introducing desired deformations according to the invention include grinding and polishing, or planing—all techniques well-known to those skilled in the art.

It will be recognized, of course, that the deforming the walls of the electrodes according to the invention must not result in substantial changes in basic dimensional parameters of the electrodes, such as the shape of the electrode, opening size, shape or alignment.

Other changes may be made in the above-described apparatus without departing from the true spirit and scope of the invention herein involved, and it is intended that the subject matter in the above depiction shall be interpreted as illustrative and not in a limiting sense.

We claim:

1. In a television cathode ray picture tube having at least one electron gun for generating at least one electron beam for projecting at least one beam spot on the picture imaging screen of said tube, said gun having a plurality of differently electrically charged electrodes having facing sections comprising juxtaposed walls with coaxially aligned openings therethrough for passage of said beam, said walls defining at least one gap in which is established a beam-focusing electrostatic field, said cathode ray tube being subject to influences which introduce an undesired distortion of said beam spot to the detriment of the quality of the image projected on said screen, said gun being characterized by at least one of said electrode walls being mechanically deformed in the perimeter of its opening to cause said field to be azimuthally asymmetrical about said opening, and effective to act on said beam in a sense tending to at least partially compensate for said undesired distortion of said beam spot.

2. The picture tube defined by claim 1 wherein the mechanical deformation comprises a depression having depth in the range of 0.0005 to 0.006 inch.

3. The picture tube defined by claim 1 wherein said mechanical deformation comprises a depression having a depth of less than 0.0015 inch.

4. The picture tube defined by claim 2 wherein said mechanical deformation comprises a protrusion having a heighth in the range of 0.0005 to 0.006 inch.

5. The picture tube defined by claim 1 wherein said mechanical deformation comprises a protrusion having a maximum heighth of 0.0015 inch.

6. The picture tube defined by claim 1 wherein said mechanical deformation comprises a combination of a depression and a protrusion having a peak-to-peak separation in the range of 0.001 to 0.012 inch.

7. The picture tube defined by claim 1 wherein said mechanical deformation comprises a combination depression and protrusion having a maximum peak-to-peak separation of 0.001 inch.

8. The electrode defined by claim 1 wherein said mechanical deformation is selected from a group consisting of a notch, trough, rosette, cruciform, ellipse, square, and circle.

9. For use in a television receiver system, a television color cathode ray picture tube of the small-neck, shadow-mask type having a picture-imaging screen with groups of red-light-emitting, green-light-emitting, and blue-light-emitting phosphor stripes deposited thereon, and having associated therewith a three-beam, unitized electron gun; that is, a gun having three electrode means common to the three beams, said gun producing in the tube neck an in-line, coplanar cluster of electron beams for projecting a red-associated, green-associated, and blue-associated beam spot on associated ones of said stripes, said gun having means for producing three beam cross-overs and focus lens means for focusing said cross-overs on said screen in the form of said beam spots, said focus lens means having a plurality of differently electrically charged electrodes having facing sections comprising juxtaposed walls with coaxially aligned openings therethrough for passage of said beams, said walls defining at least one gap in which is established a beam-focusing electrostatic field, said receiver system having influences which introduce an undesired distortion of said beam spots to the detriment of the quality of said image, said gun being characterized by at least one of said walls being mechanically deformed in the perimeter of its opening to cause said field to be azimuthally asymmetrical about said opening, and effective to act on said beam in a sense tending to at least partially compensate for said undesired distortion of said beam spots.

10. In a television cathode ray picture tube having at least one electron gun for generating at least one electron beam for projecting at least one beam spot on the picture imaging screen of said tube, said gun having a plurality of different electrically charged electrodes having facing sections comprising juxtaposed walls with coaxially aligned openings therethrough for passage of said beam, said walls defining at least one gap in which is established a beam-focusing electrostatic field, said cathode ray tube being subject to influences which introduce an undesired distortion of said beam spot to the detriment of the quality of the image projected on said screen, said gun being characterized by at least two of said juxtaposed walls being mechanically deformed in the perimeters of their openings to mutually interact and cause the field therebetween to be azimuthally asymmetrical about said openings and effective to act on said beam in a sense tending at least to partially compensate for said undesired distortion of said beam spot.

11. The television cathode ray tube defined by claim 10 wherein the mechanical deformation in the openings of the juxtaposed walls of the electron gun electrodes are substantially mirror images.

12. The television cathode ray tube defined by claim 10 wherein the mechanical deformation in the openings of the two juxtaposed walls of the electrodes of the electron gun are of different yet mutually interactive deformations.

13. The television cathode ray tube defined by claim 12 wherein the mechanical deformations of one of said juxtaposed walls comprises a depression and the deformation on the opposite wall comprises a protrusion.

14. The television cathode ray tube defined by claim 12 wherein the mechanical deformation in the opening of the two juxtaposed walls comprises a trough in each wall whose axes are parallel.

15. The television cathode ray tube defined by claim 10 wherein the mechanical deformation in the s of the openings parimeter of the two electrodes comprise troughs whose axis are at angles one to the other.

16. A method for at least partially compensating for an undesired distortion of a beam spot projected on the imaging screen of a television cathode ray picture tube by an electron gun, said gun having differently electrically charged electrodes having facing sections comprising juxtaposed walls with coaxially aligned openings therethrough for passage of said beam, said walls defining at least one gap in which is established a substantially azimuthally symmetrical electrostatic field, the method comprising designedly mechanically deforming in the perimeter of the opening at least one of said electrode walls to cause said field to be azimuthally asymmetrical about said opening, and effective to act on said beam in a sense to at least partially compensate for said undesired distortion of said beam spot.

17. A method for at least partially compensating for the undesired distortion of a beam spot projected on the imaging screen of a television cathode ray tube by at least one electron gun, said gun having a plurality of differently electrically charged electrodes having facing sections comprising juxtaposed walls with coaxially aligned openings therethrough for passage of said beam, said walls defining at least one gap in which is established a substantially azimuthally symmetrical electrostatic field, the method comprising designedly mechanically deforming in the perimeters of the openings of at least two of the electrodes having juxtaposed walls to mutually cause said field to be azimuthally asymmetrical about said openings, and effective to act on said beam in a sense to at least partially compensate for said undesired distortion of said beam spot.

* * * * *